US005641742A

United States Patent [19]

Adamy et al.

[11] Patent Number: 5,641,742

[45] Date of Patent: Jun. 24, 1997

[54] MICROEMULSION ALL PURPOSE LIQUID CLEANING COMPOSITIONS

[75] Inventors: Steven Adamy, Hamilton; Barbara Thomas, Princeton; Sat Bedi, Edison, all of N.J.

[73] Assignee: Colgate-Palmolive Co., Piscataway, N.J.

[21] Appl. No.: 518,066

[22] Filed: Aug. 22, 1995

Related U.S. Application Data

[63] Continuation-in-part of Ser. No. 368,696, Jan. 3, 1995, abandoned, which is a continuation-in-part of Ser. No. 191,967, Feb. 4, 1994, abandoned, which is a continuation-in-part of Ser. No. 48,538, Apr. 14, 1993, abandoned.

[51] Int. Cl.$^6$ ..... C11D 1/83; C11D 3/28; C11D 3/18

[52] U.S. Cl. ..... 510/500; 510/238; 510/365; 510/417; 510/463

[58] Field of Search ..... 252/DIG. 3, 153, 252/351, 352, 353, 356, 357, 547, 548, 173, 174.21, 174.23, DIG. 1, DIG. 2, DIG. 14, DIG. 15; 510/238, 365, 417, 500, 463

[56] References Cited

U.S. PATENT DOCUMENTS

| | | | |
|---|---|---|---|
| 5,024,780 | 6/1991 | Lays | 252/162 |
| 5,039,441 | 8/1991 | Thomas et al. | 252/DIG. 14 |
| 5,093,031 | 3/1992 | Login et al. | 252/357 |
| 5,112,516 | 5/1992 | Koetzle | 252/162 |
| 5,158,710 | 10/1992 | VanEenam | 252/162 X |
| 5,252,245 | 10/1993 | Garabedian, Jr. et al. | 252/547 X |
| 5,300,529 | 4/1994 | Narayanan | 514/788 |
| 5,308,403 | 5/1994 | Yam et al. | 134/7 |
| 5,326,789 | 7/1994 | Narayanan | 514/788 |
| 5,332,447 | 7/1994 | Winston et al. | 134/7 |
| 5,393,451 | 2/1995 | Koetzle | 252/162 X |
| 5,409,639 | 4/1995 | Fusiak et al. | 134/42 X |
| 5,503,778 | 4/1996 | Liu et al. | 252/542 |
| 5,523,024 | 6/1996 | Garabedian, Jr. et al. | 252/547 |

*Primary Examiner*—Douglas J. McGinty

*Attorney, Agent, or Firm*—Richard E. Nanfeldt; James Serafine

[57] ABSTRACT

An improvement is described in microemulsion compositions containing, by weight: 1% to 20% of an anionic surfactant, 0.1 to 50% of an n-alkyl pyrrolidone cosurfactant; 0% to 10% of the nonionic surfactant; 0% to 5% of a fatty acid; 0.4% to 10% of perfume or a hydrocarbon and the balance being water.

7 Claims, 7 Drawing Sheets

MICROEMULSION ALL PURPOSE LIQUID CLEANING COMPOSITIONS

RELATED APPLICATION

This application is a continuation in part application of U.S. Ser. No. 8/368,696 filed Jan. 3, 1995, abandoned, which in turn is a continuation in part application of U.S. Ser. No. 8/191,967 filed Feb. 4, 1994, abandoned, which in turn is a continuation in part application of U.S. Ser. No. 8/048,538 filed Apr. 14, 1993, abandoned.

1. Field of the Invention

This invention relates to an improved all-purpose liquid cleaner in the form of a microemulsion designed in particular for cleaning hard surfaces and which is effective in removing grease soil and/or bath soil and in leaving unrinsed surfaces with a shiny appearance.

2. Background of the Invention

In recent years all-purpose liquid detergents have become widely accepted for cleaning hard surfaces, e.g., painted woodwork and panels, tiled walls, wash bowls, bathtubs, linoleum or tile floors, washable wall paper, etc. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the layer type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surface or all-purpose liquid detergent compositions where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of about 25 to about 800 Å in a continuous aqueous phase.

In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616—Herbots et al; European Patent Application EP 0160762—Johnston et al; and U.S. Pat. No. 4,561,991- Herbots et al. Each of these patent disclosures also teaches using at least 5% by weight of grease-removal solvent.

It also is known from British Patent Application GB 2144763A to Herbots et al, published Mar. 13, 1985, that magnesium salts enhance grease-removal performance of organic grease-removal solvents, such as the terpenes, in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to about 18% by weight of the aqueous phase), the presence of such high quantities of grease-removal solvent tend to reduce the total amount of greasy or oily soils which can be taken up by and into the microemulsion without causing phase separation.

The following representative prior art patents also relate to liquid detergent cleaning compositions in the form of o/w microemulsions: U.S. Pat. Nos. 4,472,291—Rosario; 4,540,448—Gauteer et al; 3,723,330—Sheflin; etc.

Liquid detergent compositions which include terpenes, such as d-limonene, or other grease-removal solvents, although not disclosed to be in the form of o/w microemulsions, are the subject matter of the following representative patent documents: European Patent Application 0080749; British Patent Specification 1,603,047; 4,414,128; and 4,540,505. For example, U.S. Pat. No. 4,414,128 broadly discloses an aqueous liquid detergent composition characterized by, by weight:

(a) from about 1% to about 20% of a synthetic anionic, nonionic, amphoteric or zwitterionic surfactant or mixture thereof;

(b) from about 0.5% to about 10% of a mono- or sesquiterpene or mixture thereof, at a weight ratio of (a):(b) lying in the range of 5:1 to 1:3; and (c) from about 0.5% to about 10% of a polar solvent having a solubility in water at 15° C. in the range of from about 0.2% to about 10%. Other ingredients present in the formulations disclosed in this patent include from about 0.05% to about 2% by weight of an alkali metal, ammonium or alkanolammonium soap of a $C_{13}$–$C_{24}$ fatty acid; a calcium sequestrant from about 0.5% to about 13% by weight; non-aqueous solvent, e.g., alcohols and glycol ethers, up to about 10% by weight; and hydrotropes, e.g., urea, ethanolamines, salts of lower alkylaryl sulfonates, up to about 10% by weight. All of the formulations shown in the Examples of this patent include relatively large amounts of detergent builder salts which are detrimental to surface shine.

It is more difficult to form stable microemulsions from formulations containing grease-removal assisting magnesium compounds or the addition of minor amounts of builder salts, such as alkali metal polyphosphates, alkali metal carbonates, and nitrilotriacetic acid salts.

SUMMARY OF THE INVENTION

The present invention provides an improved, clear, liquid cleaning composition having improved interfacial tension which improves cleaning hard surfaces in the form of a microemulsion which is suitable for cleaning hard surfaces such as plastic, vitreous and metal surfaces having a shiny finish. More particularly, the improved cleaning compositions exhibit good grease soil removal properties due to the improved interfacial tensions, when used in undiluted (neat) form and leave the cleaned surfaces shiny without the need of or requiring only minimal additional rinsing or wiping. The latter characteristic is evidenced by little or no visible residues on the unrinsed cleaned surfaces and, accordingly, overcomes one of the disadvantages of prior art products. The instant microemulsion compositions exhibit improved oil uptake and cleaning performance.

Surprisingly, these desirable results are accomplished even in the absence of polyphosphate or other inorganic or organic detergent builder salts and also in the complete absence or substantially complete absence of grease-removal solvent.

In one aspect, the invention generally provides a stable, clear all-purpose, hard surface cleaning composition especially effective in the removal of oily and greasy soil, which is in the form of a substantially dilute oil-in-water microemulsion having an aqueous phase and an oil phase; The aqueous phase of the dilute o/w microemulsion includes, on a weight basis:

from about 0.1% to 20% by weight of an anionic surfactant;

from 0.1% to about 50% of an alkyl pyrrolidone cosurfactant;

from about 0% to about 5% of a fatty acid;

0% to 10% of a nonionic surfactant;

0 to 15% of magnesium sulfate heptahydrate; and 10 to 85% of water, said proportions being based upon the total weight of the composition and the dispersed oil phase of the o/w microemulsion is composed essentially of a water-immiscible or hardly water-soluble perfume constituting from about 0.4 to about 10% by weight of the entire composition.

Quite surprisingly although the perfume is not, per se, a solvent for greasy or oily soil, —even though some perfumes may, in fact, contain as much as about 80% of terpenes which are known as good grease solvents—the inventive compositions in dilute form have the capacity to solubilize up to about 10 times or more of the weight of the perfume of oily and greasy soil, which is removed or loosened from the hard surface by virtue of the action of the anionic and nonionic surfactants, said soil being taken up into the oil phase of the o/w microemulsion.

In the second aspect, the invention generally provides highly concentrated microemulsion compositions in the form of either an oil-in-water (o/w) microemulsion or a water-in-oil (w/o) microemulsion which when diluted with additional water before use can form dilute o/w microemulsion compositions. Broadly, the concentrated microemulsion compositions contain, by weight, 0.1% to 20% of an anionic surfactant, 0% to 10% of a nonionic surfactant, 0% to 5% of a fatty acid, 0.4% to 10% of perfume or water insoluble hydrocarbon having about 6 to 18 carbon atoms, 0.1% to 50% of an alkyl pyrrolidone cosurfactant, and 20% to 97% of water.

DETAILED DESCRIPTION OF THE INVENTION

Figure 1A:
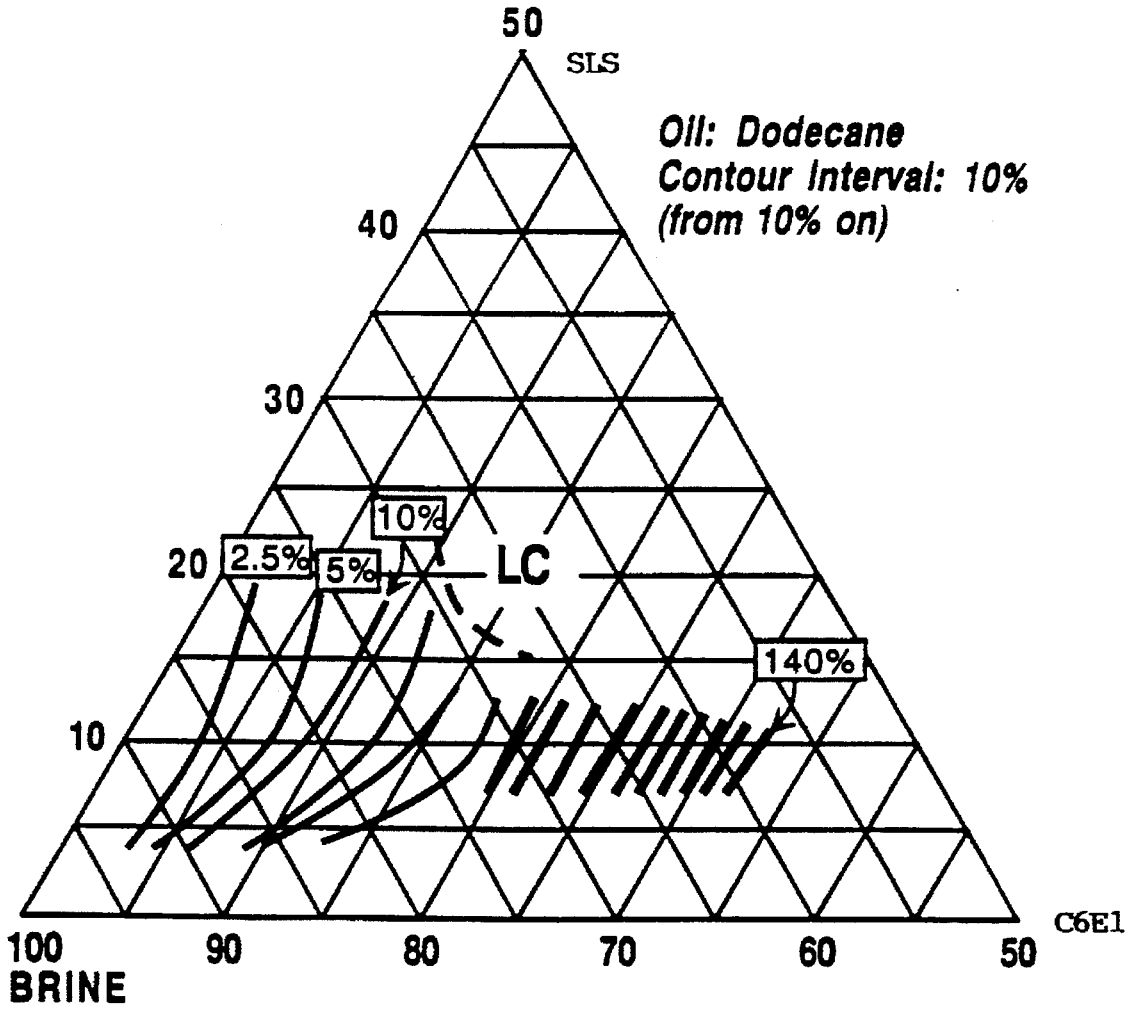
FIGS. 1, 2A and 2B are triangular diagrams describing oil uptake in the compositions of Example I.

The present invention relates to a stable microemulsion composition approximately by weight: 0.1% to 20% of an anionic surfactant, 0.1% to 50% of an alkyl pyrrolidone cosurfactant, 0% to 2.5% of a fatty acid, 0% to 10% of a nonionic surfactant, 0.1% to 10% of a water insoluble hydrocarbon, essential oil or a perfume and the balance being water wherein the microemulsion composition has a pH of at least about 7 and does not contain any gum thickeners, amine oxides, fatty acid alkanol amides such as coconut diethanol amide, water soluble glycol ethers, phosphoric acid, hydrochloric acid, amino alkylene phosphoric acid, or alkali metal inorganic or organic builder salts such as sodium carbonate, sodium citrate, tetrasodium phosphate, sodium metasilicate and sodium tripolyphosphate, and sodium monooxynol-9-phosphate. These builder salts if used in the instant compositions would cause deposits to be left on the surface being cleaned as well as destroying the optical clarity of the instant compositions.

The optically clear microemulsion compositions of the present invention are in the form of an oil-in-water microemulsion in the first aspect or after dilution with water in the second aspect, with the essential ingredients being water, an alkyl pyrrolidone cosurfactant, anionic surfactant, nonionic surfactant and a hydrocarbon or perfume.

According to the present invention, the role of the hydrocarbon can be provided by a non water-soluble perfume. Typically, in aqueous based compositions the presence of a solubilizers, such as alkali metal lower alkyl aryl sulfonate hydrotrope, triethanolamine, urea, etc., is required for perfume dissolution, especially at perfume levels of about 1% and higher, since perfumes are generally a mixture of fragrant essential oils and aromatic compounds which are generally not water-soluble. Therefore, by incorporating the perfume into the aqueous cleaning composition as the oil (hydrocarbon) phase of the ultimate o/w microemulsion composition, several different important advantages are achieved.

First, the cosmetic properties of the ultimate cleaning composition are improved: the compositions are both optically clear (as a consequence of the formation of a microemulsion) and highly fragranced (as a consequence of the perfume level).

Second, the need for use of solubilizers, which do not contribute to cleaning performance, is eliminated.

As used herein and in the appended claims the term "perfume" is used in its ordinary sense to refer to and include any non water-soluble fragrant substance or mixture of substances including natural (i.e., obtained by extraction of flower, herb, blossom or plant), artificial (i.e., mixture of natural oils or oil constituents and synthetically produced substances) odoriferous substances. Typically, perfumes are complex mixtures of blends of various organic compounds such as alcohols, aldehydes, ethers, aromatic compounds and varying amounts of essential oils (e.g., terpenes) such as from about 0% to about 80%, usually from about 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc.

The hydrocarbon such as a perfume is present in the dilute o/w microemulsion in an amount of from about 0.4% to about 10% by weight, preferably from about 0.4% to about 3.0% by weight, especially preferably from about 0.5% to about 2.0% by weight. If the amount of hydrocarbon (perfume) is less than about 0.4% by weight it becomes difficult to form the o/w microemulsion. If the hydrocarbon (perfume) is added in amounts more than about 10% by weight, the cost is increased without any additional cleaning benefit and, in fact, with some diminishing of cleaning performance insofar as the total amount of greasy or oily soil which can be taken up in the oil phase of the microemulsion will decrease proportionately.

Furthermore, although superior grease removal performance will be achieved for perfume compositions not containing any terpene solvents, it is apparently difficult for perfumers to formulate sufficiently inexpensive perfume compositions for products of this type (i.e., very cost sensitive consumer-type products) which include less than about 20%, usually less than about 30%, of such terpene solvents.

Thus, merely as a practical matter, based on economic consideration, the dilute o/w microemulsion detergent cleaning compositions of the present invention may often include as much as about 0.2% to about 7% by weight, based on the total composition, of terpene solvents introduced thereunto via the perfume component. However, even when the amount of terpene solvent in the cleaning formulation is less than 1.5% by weight, such as up to about 0.6% by weight or 0.4% by weight or less, satisfactory grease removal and oil removal capacity is provided by the inventive diluted o/w microemulsions.

Thus, for a typical formulation of a diluted o/w microemulsion according to this invention a 20 milliliter sample of o/w microemulsion containing 1% by weight of perfume will be able to solubilize, for example, up to about 2 to 3 ml of greasy and/or oily soil, while retaining its form as a microemulsion. In other words, it is an essential feature of the compositions of this invention that grease removal is a function of the result of the microemulsion, per se, and not of the presence or absence in the microemulsion of a "greasy soil removal" type of solvent.

In place of the perfume one can employ a water insoluble paraffin or isoparaffin having about 6 to about 18 carbon atoms or an essential oil at a concentration of about 0.4 to about 8.0 wt. %, more preferably 0.4 to 3.0 wt. %.

Suitable essential oils are selected from the group consisting of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Cananga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen.

Regarding the anionic surfactant suitable essential oils are selected from the group consisting of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Cananga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69° C. (China), Cyclamen Aldehyde, Diphenyl oxide, Ethyl vanilin, Eucalyptol, Eucalyptus oil, Eucalyptus citriodora, Fennel oil, Geranium off, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen present in the o/w microemulsions, any of the conventionally used water-soluble anionic surfactants or mixtures of said anionic surfactants and nonionic detergents can be used in this invention. As used herein the term "anionic surfactant" is intended to refer to the class of anionic and mixed anionic-nonionic detergents providing detersive action.

Suitable water-soluble non-soap, anionic surfactants include those surface-active or detergent compounds which contain an organic hydrophobic group containing generally 8 to 26 carbon atoms and preferably 10 to 18 carbon atoms in their molecular structure and at least one water-solubilizing group selected from the group of sulfonate, sulfate and carboxylate so as to form a water-soluble surfactant. Usually, the hydrophobic group will include or comprise a $C_8$–$C_{22}$ alkyl, alkenyl or acyl group. Such detergents are employed in the form of water-soluble salts and the salt-forming cation usually is selected from the group consisting of sodium, potassium, ammonium, magnesium and mono-, di- or tri-$C_2$–$C_3$ alkanolammonium, with the sodium, magnesium and ammonium cations again being preferred.

Examples of suitable sulfonated anionic surfactants are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_8$–$C_{15}$ alkyl phenol sulfonates.

A preferred sulfonate is linear alkyl benzene sulfonate having a high content of 3- (or higher) phenyl isomers and a correspondingly low content (well below 50%) of 2- or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

Other suitable anionic surfactants are the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred olefin sulfonates contain from 14 to 16 carbon atoms in the R alkyl group and are obtained by sulfonating an a-olefin.

Other examples of suitable anionic sulfonate surfactants are the paraffin sulfonates containing about 10 to 20, preferably about 13 to 17, carbon atoms. Primary paraffin sulfonates, made by reacting long-chain alpha olefins and bisulfites, and paraffin sulfonates having the sulfonate group distributed along the paraffin chain are shown in U.S. Pat. Nos. 2,503,280; 2,507,088; 3,260,744; 3,372,188; and German Patent 735,096.

Examples of satisfactory anionic sulfate surfactants are the $C_8$–$C_{18}$ alkyl sulfate salts and the $C_8$–$C_{18}$ alkyl ether polyethenoxy sulfate salts having the formula $R(OC_2H_4)n\ OSO_3M$ wherein n is 1 to 12, preferably 1 to 5, and M is a solubilizing cation selected from the group consisting of sodium, potassium, ammonium, magnesium and mono-, di- and triethanol ammonium ions. The alkyl sulfates may be obtained by sulfating the alcohols obtained by reducing glycerides of coconut oil or tallow or mixtures thereof and neutralizing the resultant product.

The alkyl ether polyethenoxy sulfates differ from one another in the number of moles of ethylene oxide reacted with one mole of alkanol. Preferred alkyl sulfates and preferred alkyl ether polyethenoxy sulfates contain 10 to 16 carbon atoms in the alkyl group.

The $C_8$–$C_{12}$ alkylphenyl ether polyethenoxy sulfates containing from 2 to 6 moles of ethylene oxide in the molecule also are suitable for use in the inventive compositions. These detergents can be prepared by reacting an alkyl phenol with 2 to 6 moles of ethylene oxide and sulfating and neutralizing the resultant ethoxylated alkylphenol.

Other suitable anionic surfactants are the $C_9$–$C_{15}$ alkyl ether polyethenoxyl carboxylates having the structural formula $R(OC_2H_4)_nOX\ COOH$ wherein n is a number from 4 to 12, preferably 5 to 10 and X is selected from the group consisting of $CH_2$, $C(O)R_1$ and

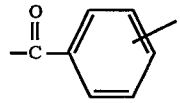

wherein $R_1$ is a $C_1$–$C_3$ alkylene group. Preferred compounds include $C_9$–$C_{11}$ alkyl ether polyethenoxy (7–9) $C(O)CH_2CH_2COOH$, $C_{13}$–$C_{15}$ alkyl ether polyethenoxy (7–9)

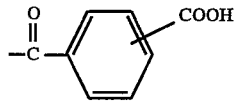

and $C_{10}$–$C_{12}$ alkyl ether polyethenoxy (5–7) $CH_2COOH$. These compounds may be prepared by condensing ethylene oxide with appropriate alkanol and reacting this reaction product with chloracetic acid to make the ether carboxylic acids as shown in U.S. Pat. No. 3,741,911 or with succinic anhydride or phtalic anhydride.

Obviously, these anionic surfactants will be present either in acid form or salt form depending upon the pH of the final composition, with the salt forming cation being the same as for the other anionic surfactants.

Of the foregoing non-soap anionic surfactants, the preferred detergents are the $C_9$–$C_{15}$ linear alkylbenzene sulfonates, the $C_{13}$–$C_{17}$ paraffin or alkane sulfonates, and the $C_8$ to $C_{18}$ alkyl sulfates. Particularly, preferred compounds are sodium $C_{10}$–$C_{13}$ alkylbenzene sulfonate, sodium $C_{13}$–$C_{17}$ alkane sulfonate, and sodium $C_{12}$–$C_{16}$ alkyl sulfate.

Generally, the proportion of the nonsoap-anionic surfactants will be in the range of 0.1% to 20.0%, preferably from 1% to 7%, by weight of the dilute o/w microemulsion composition.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such as Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water soluble nonionic detergent. Further, the length of the polyethenoxy chain can be adjusted to achieve the desired balance between the hydrophobic and hydrophilic elements.

The nonionic detergent class includes the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with 8 moles of ethylene oxide (Neodol 91-8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of about 8 to 15 and give good O/W emulsification, whereas ethoxamers with HLB values below 8 contain less than 5 ethyleneoxide groups and tend to be poor emulsifiers and poor detergents. Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic surfactants include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonylphenol condensed with about 9.5 moles of EO per mole of nonylphenol, dinonyl phenol condensed with about 12 moles of EO per mole of phenol, dinonylphenol condensed with about 15 moles of EO per mole of phenol and di-isoctylphenol condensed with about 15 moles of EO per mole of phenol. Commercially available nonionic surfactants of this type include Igepal CO-630 (nonyl phenol ethoxylate) marketed by GAF Corporation.

Also among the satisfactory nonionic surfactants are the water-soluble condensation products of a $C_8$–$C_{20}$ alkanol with a heteric mixture of ethylene oxide and propylene oxide wherein the weight ratio of ethylene oxide to propylene oxide is from 2.5:1 to 4:1, preferably 2.8:1 to 3.3:1, with the total of the ethylene oxide propylene oxide (including the terminal ethanol or propanol group) being from 60 to 85%, preferably 70 to 80%, by weight. Such detergents are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being about 75% by weight.

Condensates of 2 to 30 moles of ethylene oxide with sorbitan mono- and tri-$C_{10}$–$C_{20}$ alkanoic acid esters having an HLB of 8 to 15 also may be employed as the nonionic detergent ingredient in the described all-purpose cleaner. These surfactants are well known and are available from Imperial Chemical Industries under the Tween trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

Other suitable water-soluble nonionic surfactants which are less preferred are marketed under the trade name "Pluronics". The compounds are formed by condensing ethylene oxide with a hydrophobic base formed by the condensation of propylene oxide with propylene glycol. The molecular weight of the hydrophobic portion of the molecule is of the order of 950 to 4,000 and preferably 1,200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L62 and L64.

The proportion of the nonionic surfactant based upon the weight of the final dilute o/w microemulsion composition will be 0% to 10.0%, more preferably 0.1% to 5%, by weight.

The cosurfactant may play an essential role in the formation of the dilute o/w microemulsion and the concentrated microemulsion compositions. Very briefly, in the absence of the cosurfactant the water, detergent(s) and hydrocarbon (e.g., perfume) will, when mixed in appropriate proportions form either a micellar solution (low concentration) or form an oil-in-water emulsion in the first aspect of the invention. With the cosurfactant added to this system, the interfacial tension at the interface between the emulsion droplets and aqueous phase is reduced to a very low value. This reduction of the interfacial tension results in spontaneous break-up of the emulsion droplets to consecutively smaller aggregates until the state of a transparent colloidal sized emulsion, e.g., a microemulsion, is formed. In the state of a microemulsion, thermodynamic factors come into balance with varying degrees of stability related to the total free energy of the microemulsion. Some of the thermodynamic factors involved in determining the total free energy of the system are (1) particle-particle potential; (2) interfacial tension or free energy (stretching and bending); (3) droplet dispersion entropy; and (4) chemical potential changes upon formation. A thermodynamically stable system is achieved when (2) interfacial tension or free energy is minimized and (3) droplet dispersion entropy is maximized.

Thus, the role of cosurfactant in formation of a stable o/w microemulsion is to (a) decrease interfacial tension (2); and (b) modify the microemulsion structure and increase the number of possible configurations (3). Also, the cosurfactant will (c) decrease the rigidity at the interfacial layer of the micelle.

Generally, an increase in cosurfactant concentration results in a wider temperature range of the stability of the product.

The cosurfactant used in the instant compositions having a pH of at least about 7.0 is an n-alkyl pyrrolidone, wherein the alkyl group has about 6 to about 14 carbon atoms. Especially preferred N-alkyl pyrrolidones are N-octyl pyrrolidone and N-dodecyl pyrrolidone sold by International Specialty Products under the names of Surfadone LP-100 and Surfadone LP-300. The concentration of the N-alkyl pyrrolidone in the instant composition is about 0.1 to 10 wt. %, more preferably about 0.5 to 7 wt. %. The instant compositions do not contain any mono, di or triethylene or propylene glycol mono $C_1$–$C_6$ alkyl ethers, $C_1$–$C_4$ alkanols, polyethylene glycols or propylene glycols cosurfactants. The present of these cosurfactants in conjunction with the N-alkyl pyrrolidone surfactant in the microemulsion composition will decrease the efficiency of oil uptake of the microemulsion composition containing only the N-alkyl pyrrolidone cosurfactant.

The ability to formulate neutral products without inorganic or organic builders which have grease removal capacities is a feature of the present invention because the prior art o/w microemulsion formulations most usually are highly alkaline or highly built or both.

In addition to their excellent capacity for cleaning greasy and oily soils, the microemulsion compositions also exhibit excellent cleaning performance in neat (undiluted) as well as in diluted usage.

The final essential ingredient in the inventive microemulsion compositions having improved interfacial tension properties is water. The proportion of water in the microemulsion compositions generally is in the range of 20% to 97%, preferably 70% to 97% by weight of the usual diluted o/w microemulsion composition.

As believed to have been made clear from the foregoing description, the dilute microemulsion liquid all-purpose cleaning compositions of this invention are especially effective when used as is, that is, without further dilution in water, since the properties of the composition as an o/w microemulsion are best manifested in the neat (undiluted) form. However, at the same time it should be understood that depending on the levels of surfactants, cosurfactant, perfume and other ingredients, some degree of dilution without disrupting the microemulsion, per se, is possible. For example, at the preferred low levels of active surfactant compounds (i.e., primary anionic and nonionic surfactants) dilutions up to about 50% will generally be well tolerated without causing phase separation, that is, the microemulsion state will be maintained.

However, even when diluted to a great extent, such as a 2- to 10-fold or more dilution, for example, the resulting compositions are still effective in cleaning greasy, oily and other types of soil. Furthermore, the presence of magnesium ions or other polyvalent ions, e.g., aluminum, as will be described in greater detail below further serve to boost cleaning performance of the primary detergents in dilute usage.

On the other hand, it is also within the scope of this invention to formulate highly concentrated microemulsions which will be diluted with additional water before use.

The present invention also relates to a stable concentrated microemulsion composition having a pH of at least about 7.0 comprising approximately by weight:

(a) 0.1 to 20% of an anionic surfactant;

(b) 0 to 10% of a nonionic surfactant;

(c) 0 to 2.5% of a fatty acid;

(d) 0.1 to 50% of an alkyl pyrrolidone cosurfactant;

(e) 0.4 to 10% of a water insoluble hydrocarbon or perfume;

(f) 0 to 15% of magnesium sulfate heptahydrate; and (g) the balance being water.

Such concentrated microemulsions can be diluted by mixing with up to about 20 times or more, preferably about 4 to about 10 times their weight of water to form o/w microemulsions similar to the diluted microemulsion compositions described above. While the degree of dilution is suitably chosen to yield an o/w microemulsion composition after dilution, it should be recognized that during the course of dilution both microemulsion and non-microemulsions may be successively encountered.

In addition to the above-described essential ingredients required for the formation of the microemulsion composition, the compositions of this invention may often and preferably do contain one or more additional ingredients which serve to improve overall product performance.

One such ingredient is an inorganic or organic salt or oxide of a multivalent metal cation, particularly $Mg^{++}$. The metal salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired neutral pH level.

Preferably, in the dilute compositions the metal compound is added to the composition in an amount sufficient to provide at least a stoichiometric equivalent between the anionic surfactant and the multivalent metal cation. For example, for each gram-ion of Mg++ there will be 2 gram moles of paraffin sulfonate, alkylbenzene sulfonate, etc., while for each gram-ion of $Al^{3+}$ there will be 3 gram moles of anionic surfactant. Thus, the proportion of the multivalent salt generally will be selected so that one equivalent of compound will neutralize from 0.1 to 1.5 equivalents, preferably 0.9 to 1.4 equivalents, of the acid form of the anionic detergent. At higher concentrations of anionic detergent, the amount of multivalent salt will be in range of 0.5 to 1 equivalents per equivalent of anionic detergent.

The microemulsion compositions can include from 0% to 2.5%, preferably from 0.1% to 2.0% by weight of the composition of a $C_8$–$C_{22}$ fatty acid or fatty acid soap as a foam suppressant.

The addition of fatty acid or fatty acid soap provides an improvement in the rinseability of the composition whether applied in neat or diluted form. Generally, however, it is necessary to increase the level of cosurfactant to maintain product stability when the fatty acid or soap is present.

As example of the fatty acids which can be used as such or in the form of soap, mention can be made of distilled coconut oil fatty acids, "mixed vegetable" type fatty acids (e.g. high percent of saturated, mono-and/or polyunsaturated $C_{18}$ chains); oleic acid, stearic acid, palmitic acid, eiocosanoic acid, and the like, generally those fatty acids having from 8 to 22 carbon atoms being acceptable.

The microemulsion cleaning composition of this invention may, if desired, also contain other components either to provide additional effect or to make the product more attractive to the consumer. The following are mentioned by way of example:

Colors or dyes in amounts up to 0.5% by weight; bactericides in amounts up to 1% by weight; preservatives or antioxidizing agents, such as formalin,5-chloro-2-methyl-4-isothaliazolin-3-one; 2,6-di-tert butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added. The instant compositions do not contain any phenolic type compounds which would impart to the instant microemulsion composition an objectionable smell as well as having an adverse environmental impact. The instant compositions contain less than 3 wt. % of hydrotropes such as sodium xylene sulfonate and sodium cumene sulfonate because hydrotropes present in concentration above 3 wt. % will have an adverse effect on the balance of ingredients necessary in the formation of the instant microemulsion compositions.

In final form, the microemulsion compositions exhibit stability at reduced and increased temperatures. More specifically, such compositions remain clear having a light transmission of at least 95% and is stable in the range of 5° C. to 50° C., especially 10° C. to 43° C. Such compositions exhibit a pH in the neutral range. The liquids are readily pourable and exhibit a viscosity in the range of 6 to 60 milliPascal·second (mPas.) as measured at 25° C. with a Brookfield RVT Viscometer using a #1 spindle rotating at 20 RPM. Preferably, the viscosity is maintained in the range of 10 to 40 mPas.

The compositions are directly ready for use or can be diluted as desired and in either case no or only minimal rinsing is required and substantially no residue or streaks are left behind. Furthermore, because the compositions are free of detergent builders such as alkali metal polyphosphates they are environmentally acceptable and provide a better "shine" on cleaned hard surfaces.

When intended for use in the neat form, the liquid compositions can be packaged under pressure in an aerosol container or in a pump-type or trigger-type sprayer for the so-called spray-and-wipe type of application.

Because the compositions as prepared are aqueous liquid formulations and since no particular mixing is required to form the o/w microemulsion, the compositions are easily prepared simply by combining all the ingredients in a suitable vessel or container. The order of mixing the ingredients is not particularly important and generally the various ingredients can be added sequentially or all at once or in the form of aqueous solutions of each or all of the primary detergents and cosurfactants can be separately prepared and combined with each other and with the perfume. The magnesium salt, or other multivalent metal compound, when present, can be added as an aqueous solution thereof or can be added directly. It is not necessary to use elevated temperatures in the formation step and room temperature is sufficient.

The following examples illustrate liquid cleaning compositions of the described invention. The exemplified compositions are illustrative only and do not limit the scope of the invention. Unless otherwise specified, the proportions in the examples and elsewhere in the specification are by weight.

EXAMPLE 1

Figure 1B:
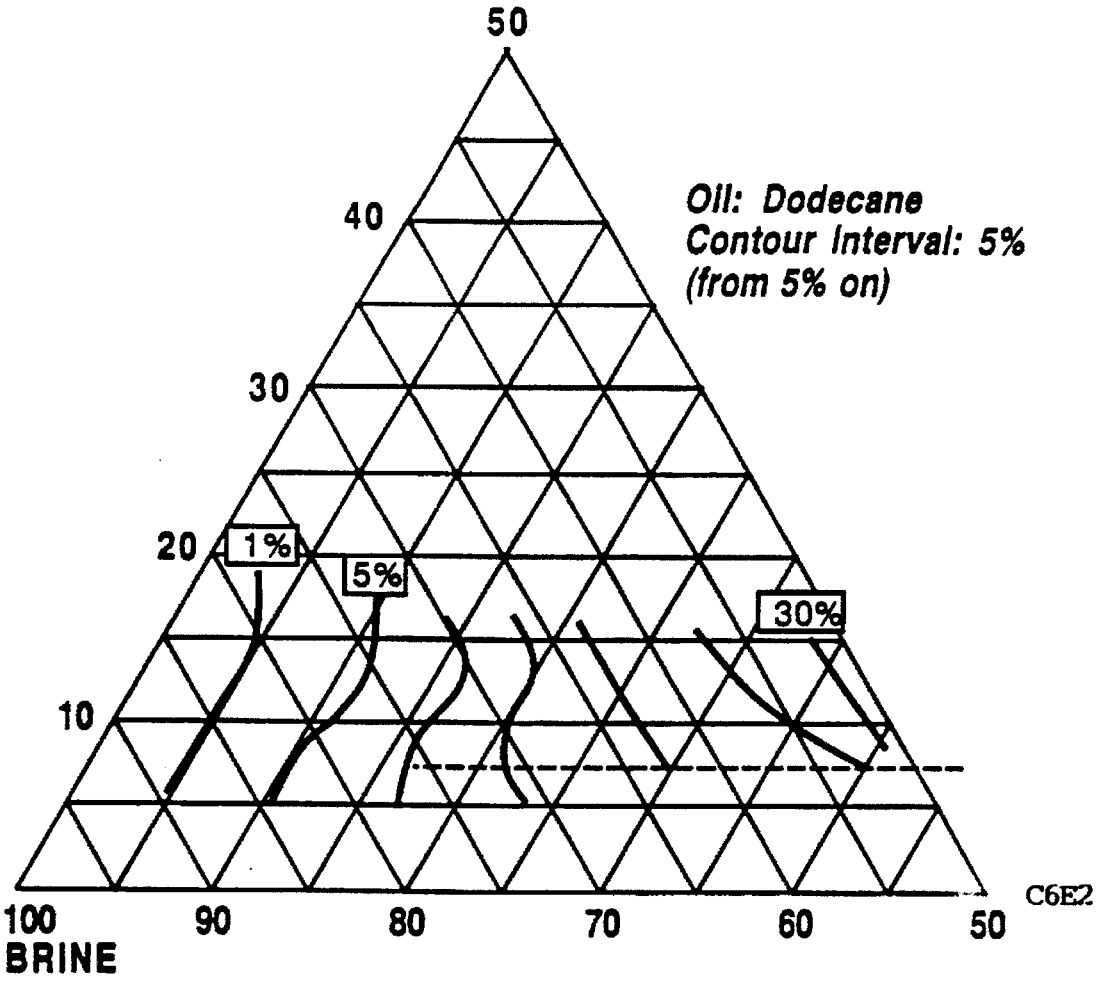
Figure 2A:
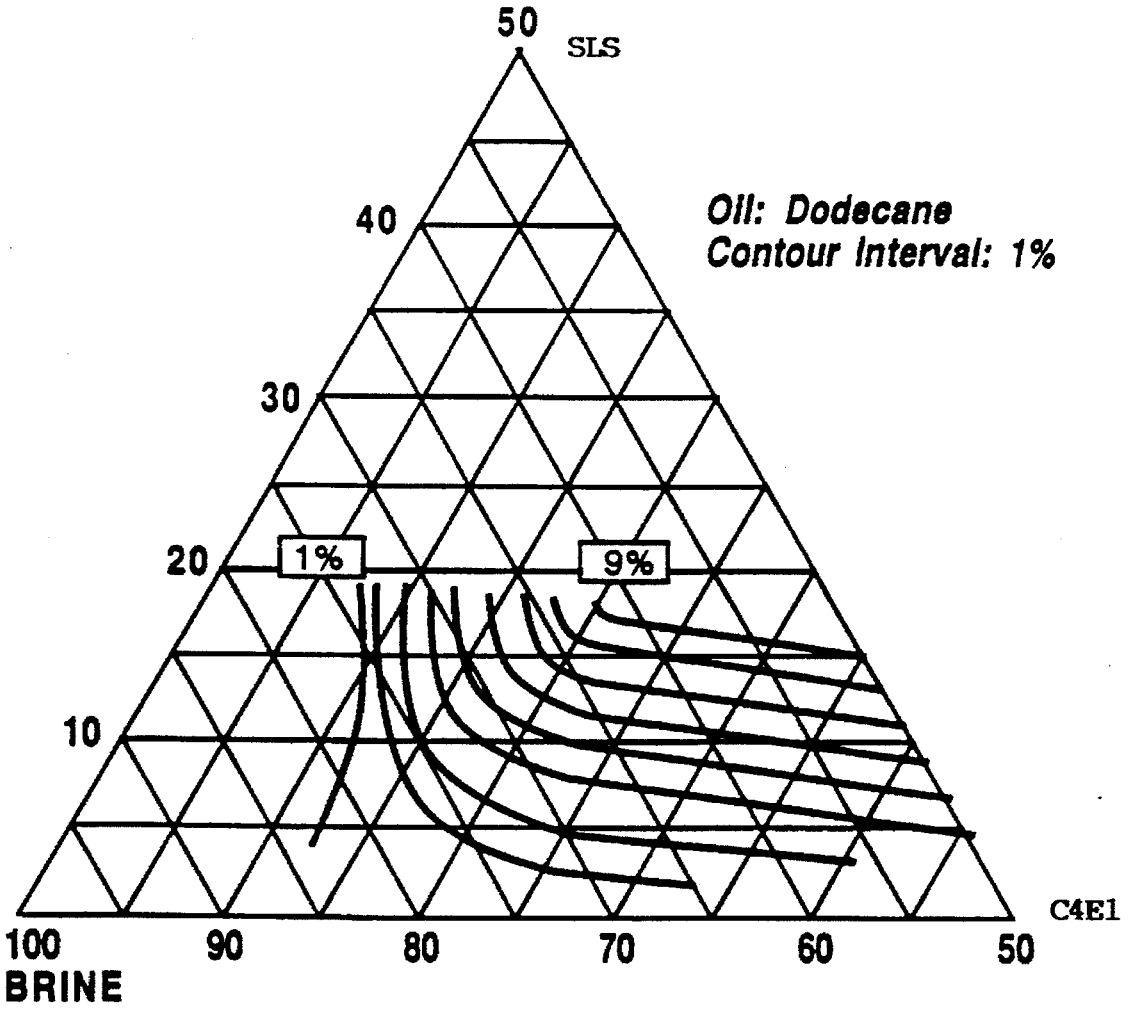
Figure 2B:
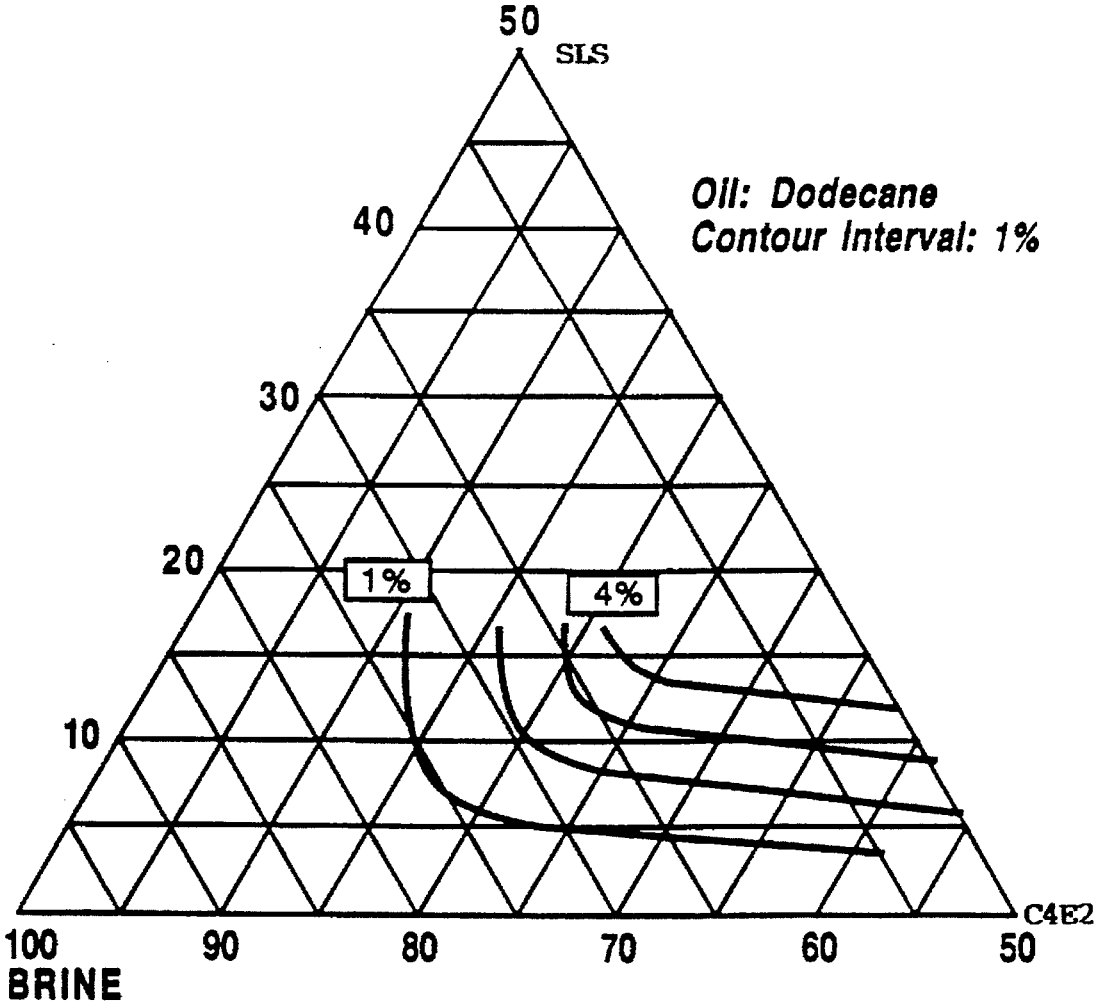

The solubilizing power of systems employing N-octyl pyrrolidone (Surfadone LP-100 from International Specialty Products) as a cosurfactant is compared with systems employing ethylene glycol monobutyl ether ($C_4E_1$) and diethylene glycol monobutyl ether ($C_4E_2$). Solubilization capacities of N-dodecane—the amount of dodecane which can be solubilized in a microemulsion so that the dispersion remains homogeneous, transparent, and stable—are plotted in FIGS. 1 and 2*a–b*. The systems described are composed of 0.15M NaCl (aq) brine, sodium lauryl sulfate (SLS), and either LP-100 (FIG. 1), $C_4E_1$ (FIG. 2*a*), or $C_4E_2$ (FIG. 2*b*). The N-dodecane solubilization capacities are presented in the form of contours of equal oil uptake plotted on the brine/SLS/cosurfactant triangular phase diagram. Note that FIGS. 1 and 2*a–b* represent partial phase diagrams, only going up to 25% SLS and 25% cosurfactant (FIG. 1) or 50% SLS and 50% cosurfactant (FIGS. 2*a–b*). The percentages shown on the contours are calculated from:

$$\%\ \text{dodecane} = \frac{\text{mass dodecane solubilized} \times 100\%}{\text{mass sum of brine, SLS, and cosurfactant}} \quad (1)$$

For example, in FIG. 1, the 5% contour lies on a composition point of 85% brine, 7.5% SLS, and 7.5% LP-100. This means that in 100 g of a composition of 85% brine, 7.5% SLS, and 7.5% LP-100, 5 g of dodecane may be solubilized before the mixture separates into two liquid phases.

Aside from employing a cosurfactant which is derived from renewable resources, systems with LP-100 display a superior solubilization performance over systems employing the more commonly used cosurfactants $C_4E_1$ and $C_4E_2$. For example, FIG. 1 shows that a system composed of 95% 0.15M NaCl (aq) brine, 2.5% SLS and 2.5% LP-100, can solubilize 1% dodecane. FIGS. 2*a–b* show that systems employing $C_4E_1$ or $C_4E_2$ in like compositions are unable to solubilize any appreciable amounts of dodecane. FIG. 1 also shows that a composition of 85% NaCl brine, 7.5% SLS, and 7.5% LP-100 is able to solubilize 5% dodecane. FIGS. 2*a–b* show that the corresponding $C_4E_1$ and $C_4E_2$ systems cannot solubilize even 1% dodecane.

The ability of a system to solubilize significant amounts of oil with lower concentrations of active ingredients is an improvement over the prior art since less residue is likely when such a system is employed as a hard surface cleaner. The feature of less residue is further implied by analyzing the orientation of the uptake contours in FIGS. 1 and 2*a–b*. FIG. 1 shows that in the LP-100 system, the contours are oriented largely toward the SLS-cosurfactant side. This means that oil solubilization is increased by increasing the amount of LP-100 and not the amount of SLS. FIGS. 2*a–b* show that the contours in the $C_4E_1$ and $C_4E_2$ systems are oriented so that oil solubilization is largely increased by increasing the amount of SLS. Because solubilization performance is increased in the LP-100 system by increasing the amount of the volatile component instead of the non-volatile surfactant, as in the $C_4E_1$ and $C_4E_2$ systems, less residue will be left on the surface in the LP-100 system. It is noted, however, that the contour orientation may depend on the chain length of the oil.

EXAMPLE 2

Figure 3:
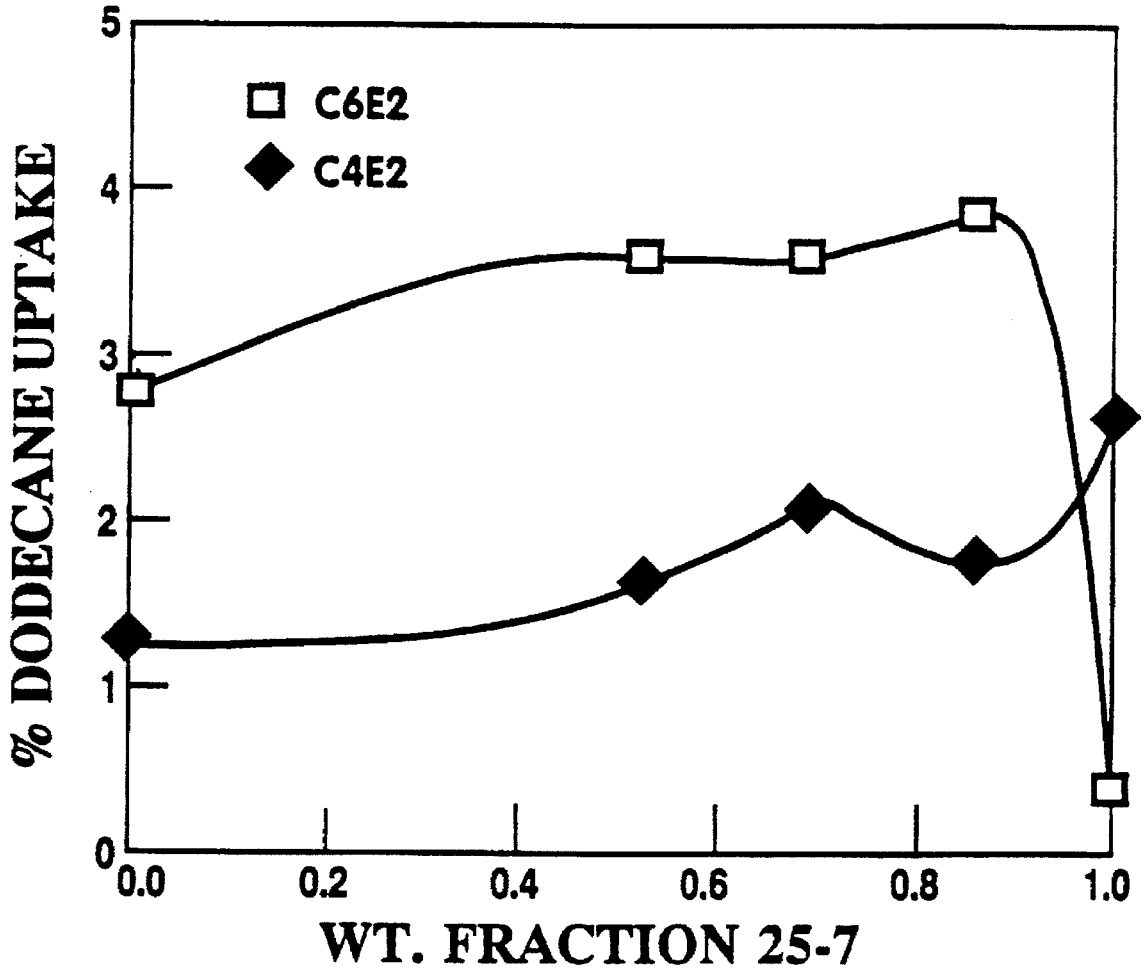
FIGS. 3 and 4 are oil uptake graphs of the compositions of Examples 2 and 3.

FIG. 3 shows the dodecane uptake capacity of a system containing LP-100 compared with systems containing propylene glycol monobutyl ether (PGMBE) and ethylene glycol monohexyl ether ($C_6E_1$). In all cases, a mixture of magnesium lauryl sulfate (MgLS) and Neodol 25-7 (from Shell Chemical, a straight chain nonionic surfactant with 12–15 carbons and 7 ethoxy groups) was used at a total concentration of 10%. The weight fraction of the Neodol 25-7 was varied from 0 to 1. The amount of cosurfactant, either LP-100, PGMBE, or $C_6E_1$, was kept constant at 4%.

FIG. 3 shows that the LP-100 system displays a significantly higher degree of dodecane uptake than the PGMBE system at all weight fractions of Neodol 25-7. The LP-100 system also displays comparable performance to the $C_6E_1$ system up to a Neodol 25-7 weight fraction of 0.6, and displays a significantly greater degree of oil uptake at Neodol 25-7 weight fractions greater than 0.6.

EXAMPLE 3

The solubilizing performance of the LP-100 system was compared with those employing $C_4E_1$ or $C_4E_2$ when triolein is the solubilized oil. In this example, microemulsions are "preformed" with dodecane as a solubilized hydrocarbon, and uptake capacities of triolein in these systems are measured. We note again that the uptake is defined as the amount of triolein which can be solubilized before the system separates into two phases. Triolein uptake in systems without dodecane has also been measured.

Figure 4:
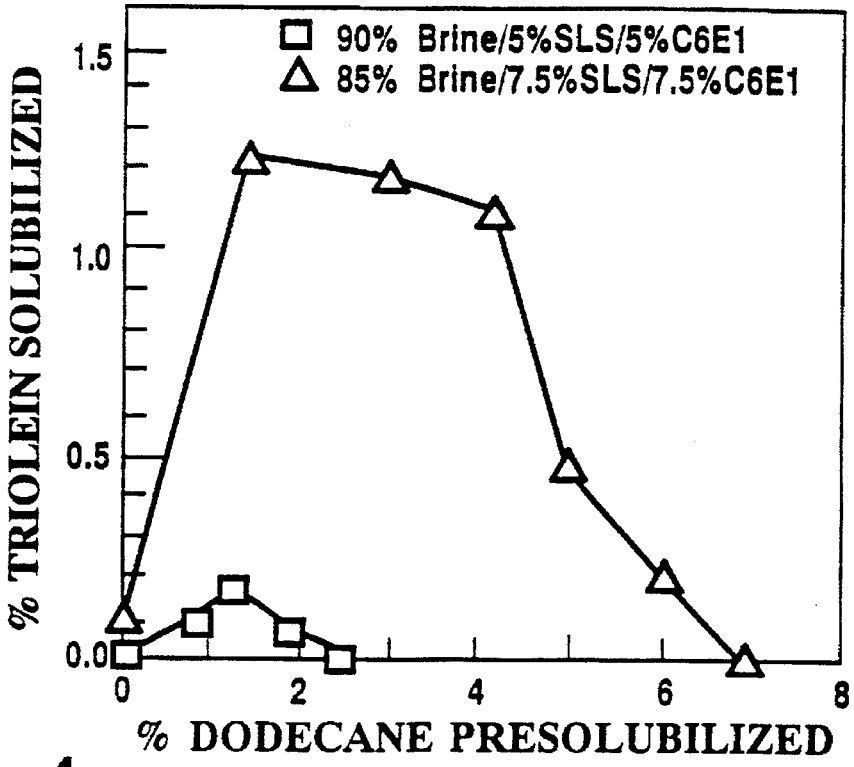

FIG. 4 shows triolein uptake in a system composed of 75% 0.15M NaCl (aq) brine, 12.5% SLS, and 12.5%

LP-100, as well as in a more dilute system composed of 90% brine, 5% SLS, and 5% LP-100. The amount of dodecane is represented as a percentage calculated by equation (1). The amount of triolein solubilized is described by:

$$\% \text{ triolein} = \frac{\text{mass triolein solubilized} \times 100\%}{\text{mass sum brine, SLS, cosurfactant, and dodecane}} \quad (2)$$

FIG. 4 shows that in a composition of 75% brine, 12.5% SLS, and 12.5% LP-100, with 4% dodecane solubilized (as defined by equation 1), 3.5% triolein (as defined by equation 2) may be solubilized before the dispersion turns cloudy. Even in the dilute case where 5% SLS and 5% LP-100 is present, 0.5% triolein may be solubilized when 1% dodecane is presolubilized. In systems employing $C_4E_1$ or $C_4E_2$ along with 0.15M NaCl (aq), SLS, and dodecane, no triolein could solubilized in mixtures with compositions comparable to those shown in FIG. 4. The fact that the systems employing LP-100 are able to solubilize significant quantities of triolein while those with $C_4E_1$ or $C_4E_2$ cannot solubilize any triolein attests to the superior performance of the LP-100 system.

EXAMPLE 4

In order to test the grease cleaning performance, two prototype neutral pH APC formulations were prepared and are described in Table 1 below.

TABLE 1

Compositions of Formulas A and B. All amounts are in weight percent.

| Component | wt. % in A | wt. % in B |
|---|---|---|
| Mg lauryl sulfate | 3 | 3 |
| Neodol 1-5 | 3 | 3 |
| Diethylene glycol monobutyl ether ($C_4E_2$) | 4 | — |
| Surfadone LP-100 | — | 4 |
| Perfume | 0.8 | 0.8 |
| Water | q.s | q.s |

The cleaning tests were performed according to the following procedure:

A mixture of 50% hard tallow and 50% soft tallow dyed with D&C Red #17 was applied to new Formica tiles (15 cm×15 cm) by spraying a chloroform solution with an air brush. For the Neat test, a 10% solution of the grease was used while for dilute, a 2% solution was used. In both cases a 0.01% solution of the dye was used. For Neat cleaning, 1.0 g of each formula was applied to sponges which were previously saturated with tap water and wrung out. For diluted cleaning, sponges were saturated with 1.2% solutions of the formulas in tap water. The sponges were placed in holders and placed in a sled of a Gardner Abrader apparatus. Each sponge holder contained 270 g of lead shot. The abrader was allowed to operate for the desired number of strokes and the Reflectance (Rd) of the tile was measured. For neat, the operation was continued stopping after 1, 3, 5, 10, 20, 35, and 50 strokes. For dilute, the sponges and holders were removed after every 15 strokes so that the sponges could be wrung out and replenished with solution.

The % cleaning was calculated according to the following equation:

$$\% \text{ cleaned} = \frac{\text{Reflectance of cleaned tile} - \text{Reflectance of soiled tile}}{\text{Reflectance of unsoiled tile} - \text{Reflectance of soiled tile}} \times 100$$

An average of three readings was used for each value.

Figure 5:
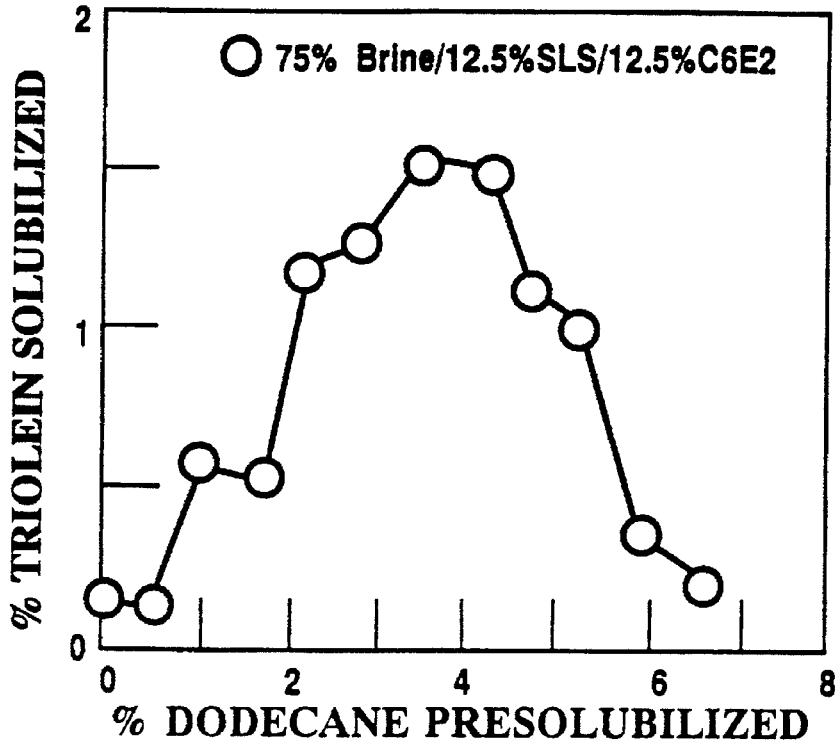
FIGS. 5A, 5B, 6A, and 6B are % cleaning graphs of the formulas of Examples 4 and 5.

FIGS. 5*a–b* compare the grease cleaning abilities of formulas A and B in neat and dilute applications. FIG. 5*a* shows that when used neat, formula B, containing LP-100 as a cosurfactant, displays a significantly faster rate of cleaning than formula A, with $C_4E_2$. In the dilute application, as shown in FIG. 5*b*, the LP-100-based formula also outperforms the $C_4E_2$-based formula.

EXAMPLE 5

We next compare the cleaning performance of a neutral pH microemulsion formula based on the LP-100 cosurfactant, formula X, with a commercial product, Ajax Frais Microemulsion which contains a water soluble glycol ether cosurfactant. Formula X is described in Table II:

TABLE II

Composition of formula X. All amounts are in weight percent.

| Component | wt. % |
|---|---|
| Mg lauryl sulfate | 3 |
| Neodol 25-7 | 3 |
| Surfadone LP-100 | 3.5 |
| Perfume | 0.8 |
| Water | q.s. |

Figure 6:
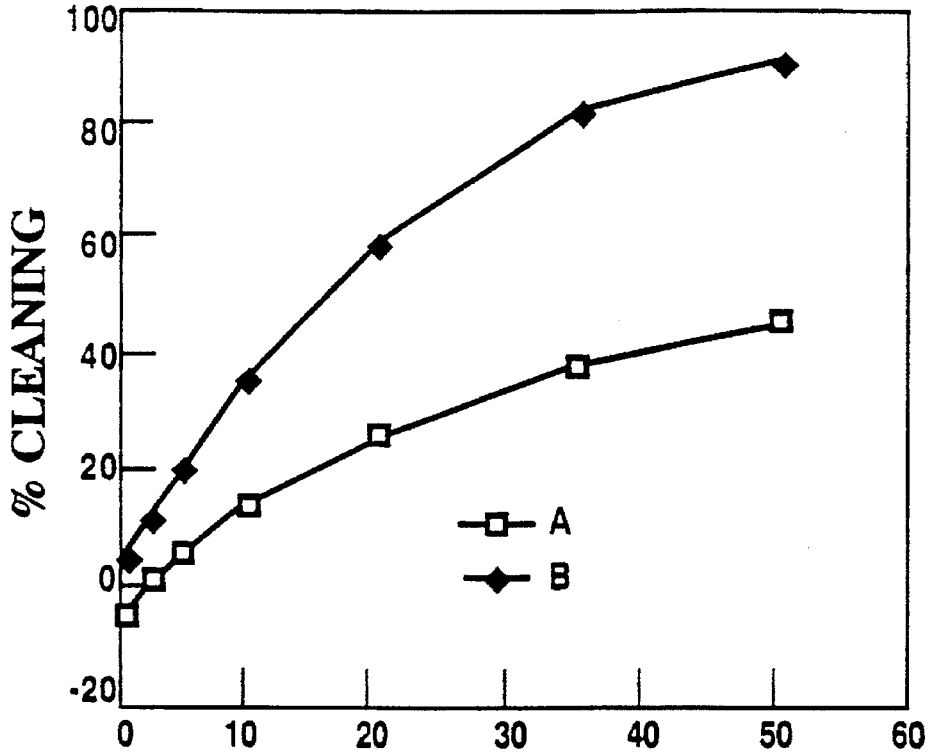
Figure 7:
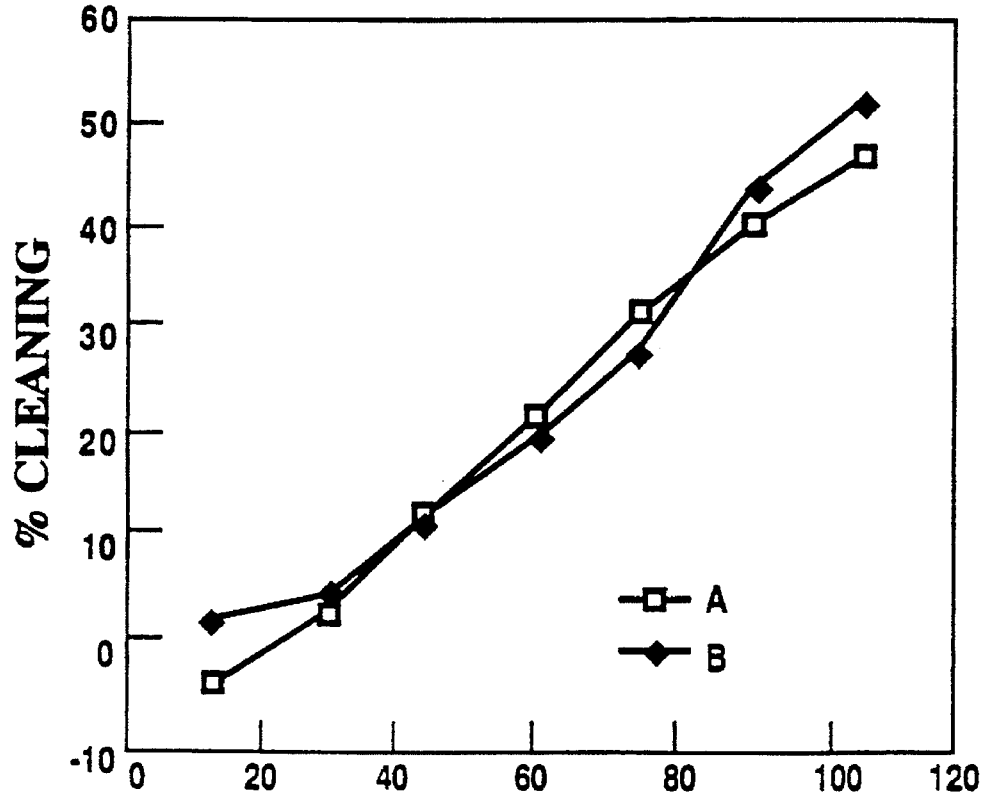

Using the cleaning procedure described in Example 4, neat and dilute performances were evaluated and are described in FIGS. 6*a–b*. FIG. 6*a* shows that in the neat application, formula X cleans slightly faster than Ajax Frais. The results of the dilute test, shown in FIG. 6*b*, also show that formula X outperforms Ajax Frais. In summary, the described invention broadly relates to an improvement in microemulsion compositions containing an anionic surfactant, a nonionic surfactant, an alkyl pyrrolidone cosurfactant, a hydrocarbon ingredient and water.

What is claimed:

1. A microemulsion composition consisting essentially of by weight:

(a) 0.1% to 20% of an anionic surfactant;

(b) 0.1% to 5.0% of a nonionic surfactant;

(c) 0.1% to 10% of a water insoluble hydrocarbon, essential oil or perfume;

(d) 0 to 2.5% of a fatty acid;

(e) 0.1% to 50% of an N-alkyl pyrrolidone, wherein the alkyl group has about 6 to about 14 carbon atoms; and (f) the balance being water, wherein said composition is optically clear and has a neutral pH and said composition does not contain any amine oxide, organic builder sales, hydrochloric acid or phosphoric acid.

2. The composition of claim 1 which further contains a salt of a multivalent metal cation in an amount sufficient to provide from 0.5 to 1.5 equivalents of said cation per equivalent of said anionic detergent.

3. The composition of claim 2 wherein the multivalent metal cation is magnesium or aluminum.

4. The composition of claim 2 wherein said composition contains 0.9 to 1.4 equivalents of said cation per equivalent of anionic detergent.

5. The composition of claim 3 wherein said multivalent salt is magnesium oxide or magnesium sulfate.

6. The composition of claim 1 wherein said fatty acid has about 8 to about 22 carbon atoms.

7. The composition of claim 1 wherein the anionic surfactant is a $C_9$–$C_{15}$ alkyl benzene sulfonate, a $C_{10}$–$C_{20}$ alkane sulfonate or a $C_8$–$C_{18}$ alkyl sulfate.

* * * * *